US010689729B2

(12) United States Patent
Lee et al.

(10) Patent No.: US 10,689,729 B2
(45) Date of Patent: Jun. 23, 2020

(54) REDUCTION DEVICE USING LIQUID METAL

(71) Applicant: KOREA INSTITUTE OF INDUSTRIAL TECHNOLOGY, Chungcheongnam-do (KR)

(72) Inventors: Uen Do Lee, Daejeon (KR); Won Yang, Seoul (KR); Byung Ryeul Bang, Seoul (KR); Soo Hwa Jeong, Busan (KR); Ji Hong Moon, Chungcheongnam-do (KR)

(73) Assignee: Korea Institute of Industrial Technology, Chungcheongnam-Do (KR)

( * ) Notice: Subject to any disclaimer, the term of this patent is extended or adjusted under 35 U.S.C. 154(b) by 138 days.

(21) Appl. No.: 15/537,025

(22) PCT Filed: Dec. 18, 2015

(86) PCT No.: PCT/KR2015/013961
§ 371 (c)(1),
(2) Date: Jun. 16, 2017

(87) PCT Pub. No.: WO2016/099209
PCT Pub. Date: Jun. 23, 2016

(65) Prior Publication Data

US 2017/0349969 A1 Dec. 7, 2017

(30) Foreign Application Priority Data

Dec. 19, 2014 (KR) ..... 10-2014-0184357

(51) Int. Cl.
*C22B 5/12* (2006.01)
*C22B 30/06* (2006.01)
(Continued)

(52) U.S. Cl.
CPC ..... *C22B 5/12* (2013.01); *C22B 13/02* (2013.01); *C22B 25/02* (2013.01); *C22B 30/06* (2013.01); *C22B 58/00* (2013.01)

(58) Field of Classification Search
CPC ..... C22B 13/02; C22B 25/02; C22B 30/06; C22B 58/00; C22B 5/12
(Continued)

(56) References Cited

U.S. PATENT DOCUMENTS

2009/0214378 A1* 8/2009 Haas ..... B22F 9/22 420/427

FOREIGN PATENT DOCUMENTS

CN 101039769 A 9/2007
KR 100305113 B1 9/2001
(Continued)

*Primary Examiner* — Jessee R Roe
*Assistant Examiner* — Michael Aboagye
(74) *Attorney, Agent, or Firm* — McNees Wallace & Nurick LLC

(57) ABSTRACT

A reduction device using a liquid metal, which can improve the oxidation reaction of a reducing agent for reducing a material to be reduced using a liquid metal, while simultaneously effectively controlling the same. The reduction device according to the present invention comprises: a storage unit in which the liquid metal is supplied and stored; a reducing agent positioned in the storage unit; a reduction unit positioned on a side of the storage unit, which receives a material to be reduced and enables fluid communication with the storage unit; and a liquid metal storage unit. According to the present invention, a reducing agent, which has strong reducing ability, is sublimated using a liquid metal, thereby further improving the reduction capability, and the same is also controlled precisely, thereby removing restrictions on use resulting from the explosive reaction of the reducing agent and guaranteeing efficient operation.

9 Claims, 1 Drawing Sheet

(51) Int. Cl.
*C22B 25/02* (2006.01)
*C22B 58/00* (2006.01)
*C22B 13/02* (2006.01)

(58) Field of Classification Search
USPC ..... 266/101, 164; 422/638, 639, 644, 645, 422/648
See application file for complete search history.

(56) References Cited

FOREIGN PATENT DOCUMENTS

| | | | |
|---|---|---|---|
| KR | 1020100031489 | A1 | 3/2010 |
| KR | 101156195 | B1 | 6/2012 |
| KR | 1020130073020 | A1 | 7/2013 |
| KR | 1020140129822 | A1 | 11/2014 |

* cited by examiner

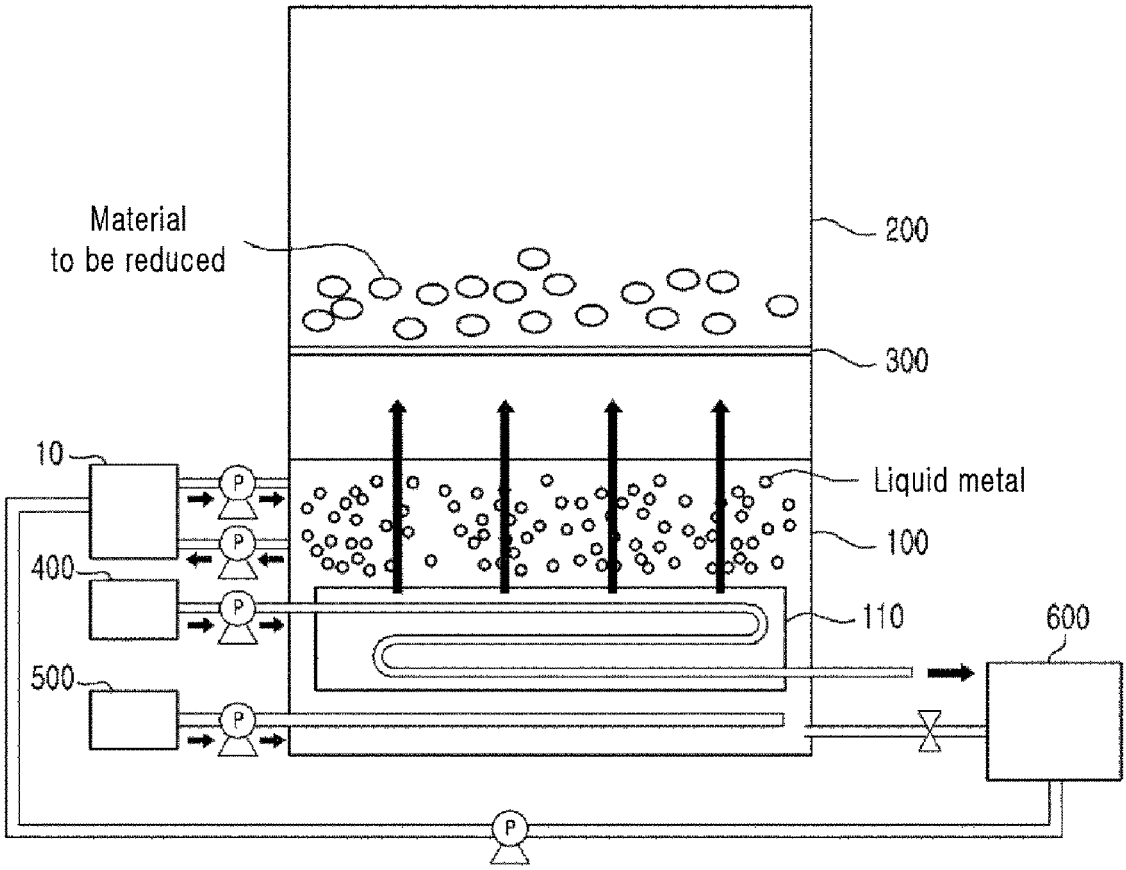
Material
to be reduced
200
300
10
Liquid metal
100
400
110
600
500
P

REDUCTION DEVICE USING LIQUID METAL

TECHNICAL FIELD

The present invention relates to a reduction device, and more particularly, to a reduction device using a liquid metal, which can effectively control the operational condition of a reducing agent for reducing a material to be reduced using a liquid metal, thereby controlling a reduction rate, while simultaneously improving safety.

The present invention was carried out at Korea Institute of Industrial Technology supported by Ministry of Strategy and Finance according to an RCOE promotion project, and was carried out in 2015 in the research title of "next generation energy production system against climate change" with assignment identification number E0150006.

BACKGROUND ART

Generally, minerals as a metal raw material existing in a natural state are present in the form of an oxide. For example, it is known that conventionally a metal oxide such as iron, copper, nickel, cobalt, etc., can be easily reduced by hydrogen gas to extract a metal. In case of a specialty metal such as tantalum (Ta), titanium (Ti), zirconium (Zr), vanadium (V), however, conventional reduction by hydrogen gas is impossible, and thus a method for reducing a metal using an alkali metal or alkaline earth metal having strong oxidizing ability (that is, reducing ability with respect to a material to be reduced) is disclosed. An example of such method for reducing a metal has been disclosed in Korean Patent Application Publication No. 2014-0129822.

However, such alkali metal and alkaline earth metal, when in contact with an oxidizing agent such as air, generate a flame, react very explosively, and are oxidized. For example, a reducing agent such as magnesium reacts with not only air but also water or carbon dioxide to oxidize or is likely to explode. In case of the form of powder, the reactivity is very high and may affect the human body upon intake of the powder, and thus a measure to prevent it is necessary. Additionally, a method of subliming or melting by applying heat is also used in order to increase the oxidizing ability, but in this case, the explosive reaction is further accelerated, disabling its control. The conventional techniques described above are a method of controlling by introducing a material to be reduced and a reducing agent in a sealed crucible and calculating an amount of reactions and a method of controlling by charging the material to be reduced into a molten melt in which the reducing agent is melted. However, the former controlling method is based on a pre-calculated reaction amount, disabling real-time control, whereas melting condition of the reducing agent of the latter controlling method has high reactivity in most cases, thereby disabling momentary control of the molten metal temperature. Accordingly, when an unpredicted occurrence takes place during the reaction, control thereof is difficult.

DISCLOSURE

Technical Problem

In this regard, the present invention has been contrived in order to solve the conventional problems described above. The present invention aims at improving reducing ability of a reducing agent as well as providing a reduction device capable of precisely controlling the improved reducing ability.

Technical Solution

To achieve the above-described object, the present invention comprises a storage unit in which the liquid metal is supplied and stored; a reducing agent block positioned in the storage unit; and a reduction unit positioned on a side of the storage unit, which receives a material to be reduced and enables fluid communication with the storage unit.

It is preferable that the reducing agent block is sublimated by the liquid metal maintained at an appropriate temperature, thereby forming reducing agent particles, and the reducing agent particles flow to the reduction unit.

It is preferable that a dispersion plate is further comprised between the storage unit and the reduction unit.

It is preferable that a refrigerant supply unit which supplies a refrigerant to the reducing agent block inside the storage unit and a first control unit which controls the refrigerant supply unit are further comprised.

It is preferable that a gas supply unit which supplies an inactive gas inside the storage unit and a second control unit which controls the gas supply unit are further comprised.

It is preferable that an amount of the reducing agent particles that pass through the dispersion plate is controlled by the first and second control units.

It is preferable that a reduction reaction of a material to be reduced is controlled by the amount of the reducing agent particles.

It is preferable that the reducing agent block 110 is a magnesium block.

It is preferable that the liquid metal is one selected from the group consisting of tin, bismuth, lead, and gallium.

It is preferable that the reducing agent block is a reservoir for a reducing agent, wherein the reservoir comprises a reservoir in the form of a mesh and the particulated reducing agents injected into the reservoir.

It is preferable that a liquid metal storage unit connected to a side of the storage unit is further comprised.

It is preferable that the liquid metal inside the storage unit is discharged to the liquid metal storage unit when temperature inside the storage unit is at a predetermined temperature or higher.

It is preferable that the liquid metal discharged from the storage unit to the liquid metal storage unit is re-heated to a melting point of the liquid metal or higher and is then re-supplied to the storage unit.

It is preferable that a liquid metal exhaust and the liquid metal storage unit are comprised at the bottom of the storage unit, and a liquid metal at a high temperature is discharged from the storage unit when temperature of the reducing agent block should be instantaneously lowered, thereby maximizing a refrigerating effect of the reducing agent block using a refrigerant.

Advantageous Effects

According to the reduction device using the liquid metal according to the present invention as described above, a reducing agent, which has strong reducing ability, is sublimated using a liquid metal, thereby further improving the reduction capability, and the same is also controlled precisely, thereby removing restrictions on use resulting from the explosive reaction of the reducing agent, and guaranteeing efficient operation. Additionally, if the reducing agent is inside the liquid metal, there is no direct contact of the reducing agent and an oxidizing agent even if the oxidizing agent is supplied to the reactor, thereby preventing oxidization or explosion, and the liquid metal coagulates in the form of surrounding the reducing agent, enabling a safe storage even after the operation.

DESCRIPTION OF THE DRAWINGS

FIG. 1 is a schematic diagram of a reduction device using a liquid metal according to an exemplary embodiment of the present invention.

MODE FOR INVENTION

The objects, features, and other advantages of the present invention as described above will be apparent from the appropriate exemplary embodiments of the present invention in detail. In this process, thicknesses of lines or sizes of constituent elements illustrated in the drawings may be exaggerated for clarity and convenience in explanation. Further, all terms to be described later are defined in consideration of functions in the present invention, and may differ depending on users, operator's intentions or customs. Accordingly, definition of such terms should be disclosed based on the contents over the whole description of the invention.

Additionally, the described exemplary embodiments are provided for illustrative purposes only and are not intended to limit the technical scope of the present invention.

Each constitutional element of the reduction device using the liquid metal according to the present invention may be used as an integrated form or separated and used respectively. Further, depending on a form of use, some of the constituent elements may be omitted.

Hereafter, the reduction device using the liquid metal according to the present invention will be described in detail with reference to the accompanying drawings (FIG. 1) (hereinafter, for convenience of description, it is referred to "reduction device").

The reduction device according to an exemplary embodiment of the present invention may comprise a storage unit 100, reducing agent block 110, reduction unit 200, dispersion plate 300, refrigerant supply unit 400, and liquid metal storage unit 600.

A liquid metal is supplied and stored in the storage unit 100 and a room for the liquid metal is prepared therein. The liquid metal heated to an appropriate temperature in the liquid metal supply unit 10 linked to the storage unit 100 may be supplied to the storage unit 100 using a pump. A heating means is located in the liquid metal supply unit 10 to heat the liquid metal.

A type of the liquid metal supplied and stored is not limited, but is preferably a metal having a low melting point and high boiling point, that is, a metal in a liquid state having a broad range of temperatures, e.g., tin, bismuth, lead, gallium, etc. Such metals have low viscosity in a liquid state and can be supplied and circulated by a simple transfer using a pump, etc.

The reducing agent block 110 is received with the liquid metal into the storage unit 100. A type of the reducing agent block 110 is not limited, but is preferably an alkali metal or alkaline earth metal having strong oxidizing ability. The reducing agent block may consist of numerous particulated reducing agents, enabling having numerous holes so that the liquid metal can flow and reach the reducing agent or receiving the particulated reducing agent using the reservoir in the form of a mesh.

For example, in case of magnesium (Mg), an exposure to the air at room temperature and normal pressure will result in a formation of magnesium oxide (MgO) or magnesium peroxide ($MgO_2$). When magnesium is in a form of powder or a fine line, it quickly reacts with oxygen and nitrogen in the air, resulting in a combustion reaction with white light and may yield magnesium oxide and magnesium nitride ($Mg_3N_2$). Magnesium also reacts with water to produce hydrogen gas and magnesium oxide ($Mg+2H_2O \rightarrow Mg(OH)_2+H_2$) and insoluble magnesium hydroxide ($Mg(OH)_2$) and hydrogen in the presence of excessive vapor. As described above, the alkali metal or alkaline earth metal including magnesium is highly reactive with various substances and causes an oxidation reaction in a wide range of temperature, and thus can be used as an effective reducing agent block 110 with respect to a material to be reduced. In particular, when solid magnesium is heated, sublimation takes place at about 550° C., and such sublimation increases exponentially as the temperature increases. As sublimated particles have a very large surface area relative to the form of powder or a line, they are likely to undergo an oxidation reaction and can be used as a strong oxidant.

However, when magnesium undergoes a combustion reaction in the air, a flame temperature may increase up to 3100° C., causing an explosive reaction. Therefore, an appropriate reduction condition in which a sublimation rate can be controlled by controlling the temperature is necessary. Accordingly, in the present invention, reactions of the reducing agent block 110 can be controlled using the liquid metal introduced in the storage unit 100.

The reduction unit 200 is positioned on a side of the storage unit 100, and a material to be reduced is received therein. The reduction unit 200 can have fluid communication with the storage unit 100, thereby enabling flow of the reducing agent particles produced by sublimation of the reducing agent block 110 by the liquid metal into the reduction unit 200, by which reduction of the material to be reduced occurs.

Herein, there may be a dispersion plate 300 between the storage unit 100 and the reduction unit 200 so that the sublimated reducing agent particles can uniformly flow into the reduction unit 200.

The refrigerant supply unit 400 connected to the storage unit 100 supplies a refrigerant to the reducing agent block 110 introduced therein. This is to independently control the temperature of the reducing agent block 110 as necessary, and may be effective when a reduction condition needs to be changed, i.e., dramatically reducing or increasing sublimation rate of the reducing agent block 110, etc.

The gas supply unit 500 connected to the storage unit 100 preferably supplies an inactive gas to the bottom of the storage unit 100. The inactive gas may play a role in transferring the sublimated reduced particles, enabling easy flow thereof, as well as controlling a concentration of the reduced particles and temperature.

The liquid metal storage unit 600 connected to a side of the storage unit 100 may be used in improving a refrigerating effect of the reducing agent block using a refrigerant by releasing the liquid metal at a high temperature from the storage unit 100 when the temperature inside the storage unit 100 needs to be instantaneously lowered. In other words, during the reduction process, the liquid metal storage unit 600 may be effective when the temperature inside the storage unit 100 is equal to a predetermined temperature or higher and requires a momentary control. In order to control the same, a valve controlling an amount of the discharged liquid metal may be between the storage unit 100 and the liquid metal storage unit 600.

Additionally, the liquid metal discharged to the liquid metal storage unit 600 is re-supplied to the liquid metal supply unit 10 and re-heated to a temperature higher than the melting point thereof. The liquid metal is then re-supplied to the storage unit 100 and may be re-used in a reduction process.

Hereinbelow, a mechanism of the reduction device according to an exemplary embodiment of the present invention will be described.

The liquid metal is first heated up to the sublimation point of the reducing block 110 or higher in the liquid metal supply unit 10 and is supplied to the storage unit 100 while controlling the pressure of the storage unit 100. The reducing agent block 110 inside the storage unit 100 is heated up to the sublimation point or higher by the liquid metal supplied to the storage unit 100 and is sublimated, producing reducing agent particles. The produced reducing agent particles flow toward the reduction unit 200 and then are uniformly dispersed by the dispersion plate 300, thereby reducing the material to be reduced in the reduction unit 200.

Herein, a reduction rate needs to be controlled, and a pressure sensor and temperature sensor are thus equipped in the storage unit 100. The reduction device may further comprise a control unit (not shown in the FIGURE) controlling the refrigerant supply unit 400, gas supply unit 500, and the liquid metal supply unit 10, which receives the information of the sensed pressure and temperature from the sensors.

For example, if sublimation rate is too high, the reduction rate can be controlled by lowering the temperature of the supplied liquid metal or supplying a refrigerant to the reducing agent block 110. Alternatively, the concentration of reducing agent particles, etc. can be controlled by controlling the supply amount of an inactive gas.

Additionally, if the temperature of the liquid metal inside the storage unit 100 is low, the liquid metal is transferred to the liquid metal supply unit 10, is re-heated, and then re-supplied back to the storage unit 100.

Further, as integratedly constituted, the control unit can control the refrigerant supply unit 400, gas supply unit 500, and liquid metal supply unit 10 integratedly. Meanwhile, the control unit consists of a first control unit (not shown in the FIGURE) connected to the refrigerant supply unit 400, a second control unit (not shown in the FIGURE) connected to the gas supply unit 500, and a third control unit (not shown in the FIGURE) connected to the liquid metal supply unit 10 and thus is able to control each supply unit 10, 400, 500 as needed.

In case of a liquid metal, due to its high heat capacity, the liquid metal is not greatly affected by surrounding temperature, and contact with the air, etc., which may affect an oxidation reaction of the reducing agent block by the liquid metal, is completely prevented. Accordingly, such method can solely control a reduction rate, enabling precise control.

As described above, according to the reduction device according to the present invention, a reducing agent having strong reducing ability is sublimated using a liquid metal, thereby further improving the reduction capability, and the same is also controlled precisely, thereby removing restrictions on use resulting from the explosive reaction of the reducing agent, and guaranteeing efficient operation.

Additionally, if the reducing agent is inside the liquid metal, there is no direct contact of the reducing agent and an oxidizing agent even if the oxidizing agent is supplied to the reactor, thereby preventing oxidization or explosion, and the liquid metal coagulates in the form of surrounding the reducing agent, enabling a safe storage even after the operation.

Even though the embodiments of the present disclosure have been described and illustrated, the present disclosure is not limited to the specific embodiments but may be modified in various ways by those skilled in the art without departing from the scope of the present disclosure defined by the appended claims, and such modifications should not be interpreted separately from the technical feature and prospect of the present disclosure.

DESCRIPTION OF REFERENCE NUMERALS

10: Liquid metal supply unit
100: Storage unit
110: Reducing agent block
200: Reduction unit
300: Dispersion plate
400: Refrigerant supply unit
500: Gas supply unit
600: Liquid metal storage unit

The invention claimed is:

1. A device for reducing a material using a liquid metal, comprising:
- a storage unit containing the liquid metal;
- a reducing agent block positioned in the storage unit; and
- a reduction unit positioned on a side of the storage unit in fluid communication with the storage unit, which receives a material to be reduced;
- wherein the reducing agent, after sublimation, flows to the reduction unit via fluid communication;
- wherein the liquid metal is different from the reducing agent; and
- wherein the reduction device further comprises a dispersion plate positioned between the storage unit and the reduction unit.

2. The device of claim 1, wherein the reduction device further comprises a refrigerant supply unit configured to supply a refrigerant to the reducing agent block in the storage unit and a first controller controlling a flow of refrigerant from the refrigerant supply unit to the storage unit based on information received from at least one of a temperature sensor or a pressure sensor.

3. The device of claim 2, further comprising a gas supply unit supplying an inactive gas to the storage unit and a second controller controlling the flow of inactive gas from the gas supply unit to the storage unit based on information received from at least one of a temperature sensor or a pressure sensor.

4. The device of claim 3, wherein an amount of reducing agent particles passing through the dispersion plate is controlled by the first and second controllers.

5. The device of claim 4, wherein a reduction reaction of the material to be reduced is controlled by the amount of the reducing agent particles.

6. The device of claim 1, wherein the reducing agent block is a magnesium block.

7. The device of claim 1, wherein the liquid metal is one selected from the group consisting of tin, bismuth, lead, and gallium.

8. The device of claim 1, wherein the reducing agent block is a reservoir for the reducing agent, wherein the reservoir comprises a reservoir comprising a mesh and a particulated reducing agent which the reservoir receives.

9. The device of claim 5, wherein the reduction device further comprises a liquid metal storage unit connected to a side of the storage unit.

* * * * *